United States Patent [19]

Moses, Jr.

[11] 4,337,088

[45] Jun. 29, 1982

[54] NON-MAGNETIC STABILIZER

[76] Inventor: Edward L. Moses, Jr., 1775 Saint James Pl., Suite 170, Houston, Tex. 77056

[21] Appl. No.: 149,290

[22] Filed: May 12, 1980

[51] Int. Cl.[3] ..... C22C 38/22; C22C 38/24; C22C 38/38; C22C 38/40

[52] U.S. Cl. ..... 75/128 A; 75/128 C; 75/128 W; 308/4 A

[58] Field of Search ..... 75/128 W, 128 C, 128 A

[56] References Cited

U.S. PATENT DOCUMENTS

| | | | |
|---|---|---|---|
| 3,112,195 | 11/1963 | Souresny | 75/128 A |
| 3,592,634 | 7/1971 | Denhard, Jr. et al. | 75/128 W |
| 3,912,503 | 10/1975 | Schumacher et al. | 75/128 C |

*Primary Examiner*—W. Stallard

*Attorney, Agent, or Firm*—Guy E. Matthews; Leland D. Schultz

[57] ABSTRACT

Present invention relates to the manufacture of any type of stabilizer for use in the rotary drilling of oil wells when the stabilizer is made of non-magnetic metals, more specifically Nitronic 60 and/or Nitronic[2] 50 having wear resistant and anti-galling characteristics.

2 Claims, No Drawings

NON-MAGNETIC STABILIZER

BACKGROUND OF THE INVENTION

This invention relates to the use of previously unused metals to manufacture a non-magnetic stabilizer for use in the rotary drilling of oil and gas wells. Previously such stabilizers were made of low alloy steels such as AISI 4140 which are suitable because they are strong, hard, have high fatigue failure characteristics and exhibit little wear when used in the drill string.

As is well known, stabilizers are used to stabilizer the drill string in that stabilizers prevent the "pendulum effect" or swinging of drill strings so as to prevent the drill bit from moving or drifting back and forth. Further, stabilizers are used in packed hole assemblies and are further used for proper maintenance of desired angles and directional drilling.

There are many examples of stabilizers including spiral, flat or straight and four bladed stabilizers such as disclosed in U.S. Pat. No. 3,285,678, U.S. Pat. No. 2,973,996, U.S. Pat. No. 3,454,305, U.S. Pat. No. 3,343,615, and U.S. Pat. No. 3,482,889.

It is also known to use non-magnetic alloy steels in drill strings; however, these low carbon non-magnetic steels do not have to have the characteristics that stabilizers do in that the stabilizer blades, by definition prevent wear and tear on the drill string by preventing the drill string from contacting the side of the well bore to thus prevent tubular wall sticking.

If it is desired to utilize electric and/or magnetic type well bore logging then the desirability of using non-magnetic drill strings is apparent; however, to date and as far as is presently known, no one has attempted to manufacture stabilizers, which presently are magnetic, of the types of metals set forth hereinbelow with the result that magnetic stabilizers used on non-magnetic drill collars causes distortion and drift of the well logging apparatus due to the magnetic characteristics of the magnetic stabilizers, which renders magnetic and/or electric well bore logging results inaccurate.

SUMMARY OF THE INVENTION

The present invention includes the manufacture of a stabilizer out of extremely tough, hard, high fatigue characteristic metals, which metals further have the characteristic of being non-magnetic for use with non-magnetic drill strings to enable more accurate readings from the use of electric and/or magnetic well logging apparatus.

DESCRIPTION OF THE PREFERRED EMBODIMENT

This invention relates to the manufacture of stabilizers by the use of the metals *Nitronic$^2$ 50 and/or Nitronic 60, such stabilizers having the shape of any of the stabilizers set forth in the above-referenced patents or any other configuration desired with the understanding that such stabilizer must be connected to the non-magnetic drill string in a manner so desired and/or normally comprise a body in outwardly extending stabilizer blades as set forth in each of such patents for contacting the size of the well bore to prevent wall sticking and to enable the performance of other characteristics of the stabilizers as set forth hereinabove.

*Trademark of Armoco Steel Corporation

In the preferred embodiment of the invention the stabilizer may be manufactured of either Nitronic$^2$ 50 and Nitronic 60.

Nitronic$^2$ 50 has the following characteristics relating to its chemical analysis:

| |
|---|
| C - .03/.06 |
| Mn - 4.00/6.00 |
| P - .04 |
| S - .03 |
| Si - 1./1.00 |
| Cr - 20.50/23.50 |
| Ni - 11.50/13.50 |
| Mo - .50/3.00 |
| V - .10/.30 |
| N - .20/.40 |
| Cb - .10/.30 |

Nitronic 60 has the following characteristics relating to its chemical analysis:

| |
|---|
| C - .10 |
| Mn - 7.0/9.0 |
| Si - 3.50/4.50 |
| Cr - 16.00/18.00 |
| Ni - 8.00/9.00 |
| N - .08/.18 |

It is further to be understood that Nitronic$^2$ 50 and Nitronic 60 are each anti-galling and wear resistant austenitic stainless steel metals and are further nonmagnetic.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth is to be interpreted as illustrative and not in a limiting sense.

The invention having been described, what is claimed is:

1. A non-magnetic stabilizer for use in rotary rig drilling of boreholes with non-magnetic drill collars and having wear resistant and anti-galling characteristics, which comprises an elongated body having means for contacting the borehole to stabilize the body within the borehole, said body being manufactured of an alloy consisting of by weight:

| |
|---|
| C - .3/.06% |
| Mn - .4.00/6.00% |
| P - .04% |
| S - .03% |
| Si - 1.00% |
| Cr - 20.50/23.50% |
| Ni - 11.50/13.50% |
| Mo - .50/3.00% |
| V - .10/.30% |
| N - .20/.40% |
| Cb - .10/.30% |
| Fe - balance |

2. A non-magnetic stabilizer for use in rotary rig drilling of boreholes with non-magnetic drill collars and having wear resistant and anti-galling characteristics, which comprises an elongated body having means for contacting the borehole to stabilize the body within the borehole, said body being manufactured of an alloy consisting of by weight:

| |
|---|
| C - .10% |
| Mn - 7.0/9.0% |
| Si - 3.50/4.50% |
| Cr - 16.00/18.00% |
| Ni - 8.00/9.00% |
| N - .08/.18% |
| Fe - balance |

* * * * *